US006751922B1

(12) United States Patent
Auriemma

(10) Patent No.: US 6,751,922 B1
(45) Date of Patent: Jun. 22, 2004

(54) FACETED RADIUS GRID

(75) Inventor: Joseph Auriemma, Jeffersonville, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 10/374,850

(22) Filed: Feb. 25, 2003

(51) Int. Cl.[7] ..... E04C 3/30

(52) U.S. Cl. ..... 52/733.1; 52/731.7; 52/506.07; 52/506.06

(58) Field of Search ..... 52/506.07, 506.06, 52/731.7, 733.1; 29/897, 897.31, 897.312, 432, 34 R; 72/203

(56) References Cited

U.S. PATENT DOCUMENTS

| | | | | |
|---|---|---|---|---|
| 3,189,139 A | * | 6/1965 | Znamirowski et al. | 52/506.07 |
| 4,128,978 A | * | 12/1978 | Beynon | 52/241 |
| 4,783,946 A | * | 11/1988 | Boegle | 52/733.1 |
| 4,893,444 A | * | 1/1990 | Ollinger et al. | 52/232 |
| 4,932,170 A | | 6/1990 | Spear | |
| 5,088,261 A | * | 2/1992 | Mieyal et al. | 52/733.1 |
| 6,047,512 A | | 4/2000 | Wendt et al. | |
| 6,374,564 B1 | | 4/2002 | Fletterick et al. | |
| 6,434,908 B1 | * | 8/2002 | Ferrante | 52/731.7 |

OTHER PUBLICATIONS

Armstrong Drywall Furring System Detail—Typ. Vaulted Ceiling; DW–20–02, 1 page.
Armstrong Drywall Furring System Detail/Furring Channel; DW–20–03, 1 page.
Armstrong Drywall Barrel Vault in Carousel Court; DW–23, 1 page.
Armstrong Drywall Barrel Vault in Carousel Court; DW–23–01, 1 page.
Armstrong Drywall Furring System Detail—Typ. Vaulted Ceiling; DW–20–01, 1 page.
Convex/Concave Radius Installation Steps, 1 page.
Four photographs (4 pages).

* cited by examiner

*Primary Examiner*—Laurie K. Cranmer
(74) *Attorney, Agent, or Firm*—Eugene Chovanes

(57) ABSTRACT

A straight roll formed beam for a curved suspended ceiling capable of being formed into a curve at the job site. The straight beam has cutouts that leave a segment of the bulb of the beam in place to give the straight beam rigidity after it is roll formed from metal strip. In the field, the bulb segment at a cutout is cut to permit the beam to be bent into a faceted curve. The bend at the cutout is fixed by a splice plate.

5 Claims, 3 Drawing Sheets

FACETED RADIUS GRID

BACKGROUND OF THE INVENTION

1. Field of the Invention

The present invention relates to a curved suspended ceiling having a grid of inverted T beams suspended from a structural ceiling, with drywall boards fastened to the grid.

2. Description of the Prior Art

Suspended ceilings in rooms are common. They have a grid of metallic beams that is suspended from an overhead structural ceiling, as by wires.

The metallic beams used in the grids of suspended ceilings are made in a continuous process, wherein a continuous strip of metal, usually steel, fed off a reel, is continuously and sequentially passed through a series of rolls that form the metal into an inverted T cross section having a web, a bulb at the top of the web, and horizontal flanges extending from the bottom of the web. Such beam construction is well-known.

A straight, finished beam continuously emerges from the roll forming operation, and is cut, on the run, into suitable lengths, of, for instance, 12 feet, or 4 feet, or 2 feet, with, for instance, a flying shear. Connectors are then formed at the ends of the straight beam lengths. The beams are then stacked and packaged for shipment to the job site for assembly into the grid of a flat, horizontal suspended ceiling. The beam cross section gives the beam rigidity throughout these operations.

The beams are formed into a grid at the job site, in the well-known prior art manner, by means of the connectors at the ends of the beam.

In a panel suspended ceiling, panels are laid in the grid openings and supported by the flanges of the beams. In a drywall suspended ceiling, drywall boards are attached to the beams of the grid by screws.

Both types of ceilings described above extend in a horizontal plane. Virtually all suspended ceilings are horizontal.

Occasionally, suspended ceilings that are curved are installed, particularly of the drywall type. In a curved drywall suspended ceiling, a grid of curved beams is suspended by wires from a structural ceiling, and drywall panels then are attached to the grid by screws, as in a horizontal drywall suspended ceiling. The faces of the drywall panels are wetted and then are bent to the desired shape prior to attachment to the grid.

In one form of curved drywall suspended ceiling, the grid is formed of straight beams that are curved into facets to form the desired radius, at the job site. This involves forming facets by slitting, as with shears, the bulb and web of each beam, normal to the length of the beam, at, for instance, 8 inch spaced intervals, resulting in 8 inch facets, at the job site, and bending the beam at each slit, between facets, to the desired radius. Clips are then affixed over the slits to fix the curve. This requires a custom operation at the job site that is time-consuming, since the slits are located and made, and the clips attached, individually. The work is done at the site since the beams, after being slit, and before the clips are attached, are very flimsy and cannot be handled in the traditional way of uncut, straight beams. Straight unslit beams are stacked, shipped, and installed, as relatively rigid pieces. In slitting the beams through the bulb and web, the beam effect is destroyed, not to be restored until the clips are installed.

Another form of curved drywall ceiling is shown in U.S. Pat. No. 6,047,512, wherein the grid beams are pre-formed and pre-engineered into true curves at the factory. Pre-engineered sections have integral webs that have no web cuts, but are curved at the factory into various radii. This requires an inventory of various sizes and shapes, which are custom assembled at the job site, or at the factory, in a time-consuming and intricate procedure.

SUMMARY OF THE PRESENT INVENTION

In the present invention, straight, inverted T beams are continuously roll formed from strip metal, at the factory, in the usual prior art way. Such beams are of inverted T cross section with a bulb at the top, a downward extending vertical web, and horizontal flanges extending from the bottom of the web. The two layers of the web are continuously stitched together.

The present invention permits the above prior art straight beams to be efficiently converted into curved beams. Cutouts in the beam, at spaced intervals along the beam, are made continuously and contemporaneously with the roll forming operations, in a portion of the web and a bulb. A segment of the bulb is left in place above the cutout to maintain the integrity of the straight beam. The cutouts do not impair the beams' integrity during handling and shipping to the job site. The cutouts are manually extended through the remaining segment of the bulb at the job site with a minimum of cutting and no need for measuring, and the beam is bent to the required radius, at the cutouts, between facets. Splice plates are applied over the extended cutouts at the bend to fix the beam at the desired faceted curve.

The cutouts are continuously and simultaneously made in the beam, for instance at 8, 16, or 24-inch intervals, as the beams are being continuously roll formed in the usual prior art roll forming operation. No manual effort is required in forming these cutouts. The preferred form of cutout has a V-shape at the bottom, with upwardly extending arms from the sides of the V. There is left a segment of the bulb, in the beam, at the top of the cutout, along with a portion of the web left at the bottom of the cutout, which is sufficient to maintain integrity of the straight beam during the cutting of the continuous moving beam into beam lengths, the forming of the connectors at the end of the lengths, the shipping to the job site, and the handling at the job site. At the job site, the bulb segment remaining in the beam above the cutouts, between facets, is snipped, for instance, with shears to permit the beam to be bent, between facets, into a faceted, convex or concave radius, and splice plates are applied at the cutouts by screws to fix the beam in this faceted radius.

The invention eliminates the need for an inventory of factory precurved beams, of different radii and different sized segments, that are subsequently assembled and fixed at the job site, as in one form of curved suspended ceiling in the prior art, or for time-consuming slitting, and fashioning, from an integral, straight beam, into a faceted curved beam, at the job site, as in another form of curved suspended ceiling in another form of prior art.

DESCRIPTION OF THE PREFERRED EMBODIMENT

Figure 1:
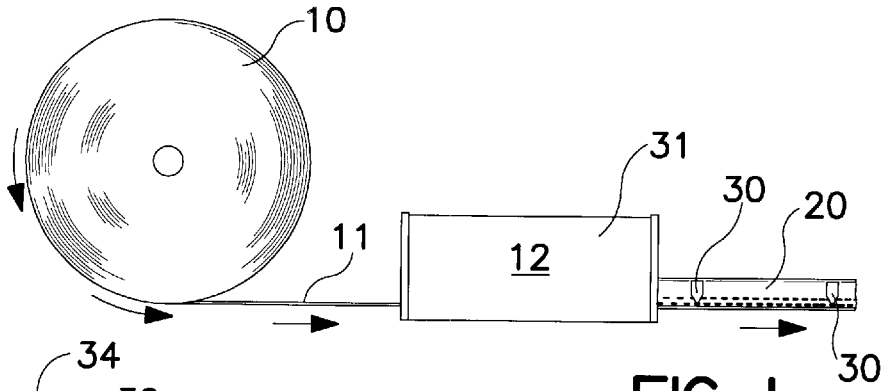
FIG. 1 is a block diagram showing figuratively the continuous production of a beam of the invention from a coil of strip metal.
Figure 2:
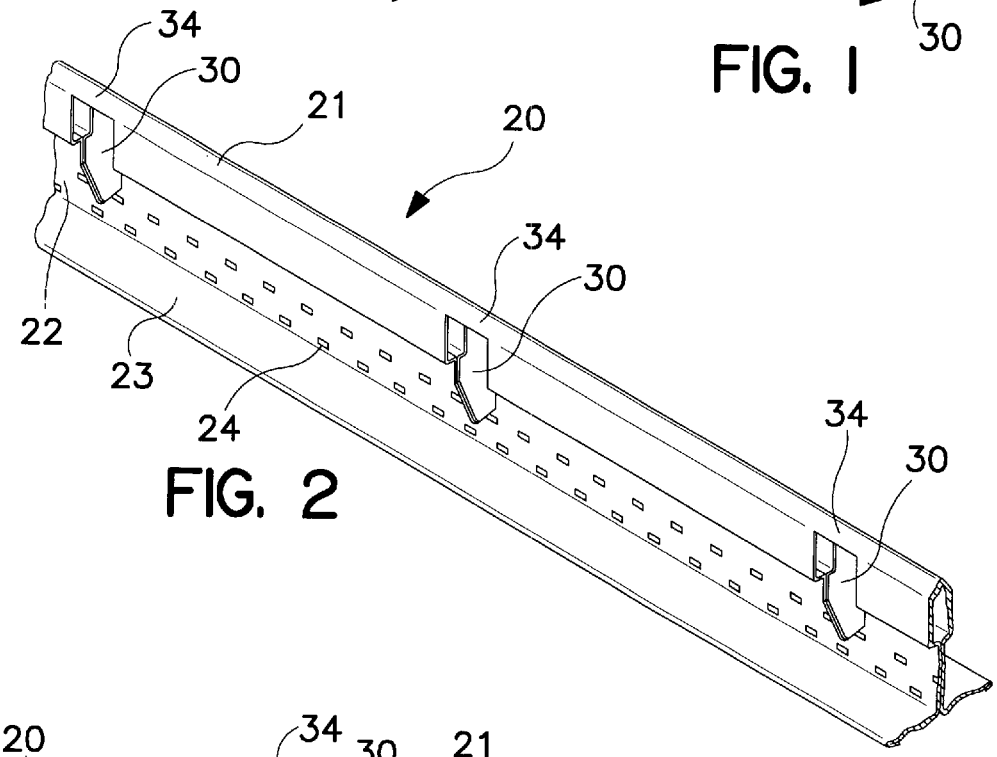
FIG. 2 is a perspective view of the beam of the invention showing cutouts.

As seen figuratively in FIG. 1, a reel 10 of strip metal 11, usually steel, is continuously unwound to feed the strip through a roll forming operation 12.

There continuously emerges from such roll forming operation 12 a straight beam 20 of inverted T cross section having a bulb 21, web 22, and horizontal flanges 23 and 25. Stitches 24 hold the layers of the web 22 together. Such roll forming operation 12 is well-known in the prior art.

As the straight, finished beam 20 continuously emerges from the roll forming operation 12, it is continuously cut into suitable lengths, for instance 12 feet, or 4 feet, or 2 feet, as with a flying shear. Connectors, well-known in the art, are formed on the ends of the straight beams. The beams 20 are then stacked and packaged for shipment to the job site for assembly into the grid of a suspended ceiling.

The beam 20 cross section, in inverted T form, as it emerges from the roll forming operation 12, gives the beam rigidity, which permits the beam 20 to be handled during further processing, packaging, shipment, and installation, without collapse. Beams of this type are well-known, and used extensively to form grids in suspended ceilings, that hang from structural ceilings by wires. Such grids are used primarily for panel suspended ceilings, where panels are laid in the grid openings, and supported on the beam flanges.

Beams of this type are also used, however, in drywall ceilings, where drywall panels are fastened to the beam flanges from below, by self-tapping screws that pass through the drywall into the flanges 23 and 25 of the beam. The beam 20 of the invention is particularly adapted to a drywall ceiling, although it can be used in a panel ceiling.

The above description is directed to the prior art.

In the beam 20 of the invention, cutouts 30 are continuously formed in the beam 20 as the beam 20 is continuously being roll formed in the roll forming operation 12 as described above. The cutouts 30 can be formed by passing the roll formed beam 20 through a set of two rolls at 31, as seen figuratively in FIG. 1, wherein one of the rolls is a punch and the other is a die.

Figure 3:
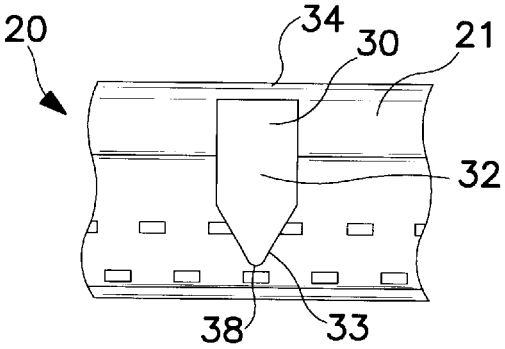
FIG. 3 is a side elevation of the beam of the invention.

The cutout 30 itself, as seen particularly in FIG. 3, is generally a vertically disposed rectangle 32 with a V shaped bottom 33. The cutout 30 leaves a segment 34 of the bulb 21, and a web portion at the bottom of the cutout 30, in place in the beam 20 to provide rigidity to the beam 20 at the cutout 30.

By means of the bulb segment 34, and the remaining web portion, the beam 20 maintains its rigidity for handling, including cutting the continuous beam 20 into lengths, as described above, forming connectors at the ends, packaging, shipping to the job site, and handling at the site.

The beam 20 with the cutouts 30, is also of sufficient rigidity to be used as a straight beam where needed.

Figure 4:
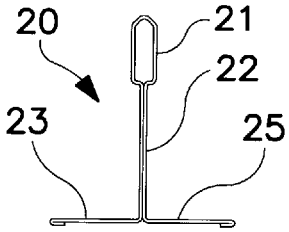
FIG. 4 is an end elevation of the beam of FIG. 3.

The cutout 30 can have representative dimensions of 0.625 inches in width and 1.337 inches in height, in a beam having an overall height of 1.696 inches, as shown in FIGS. 3 and 4.

Figure 5:
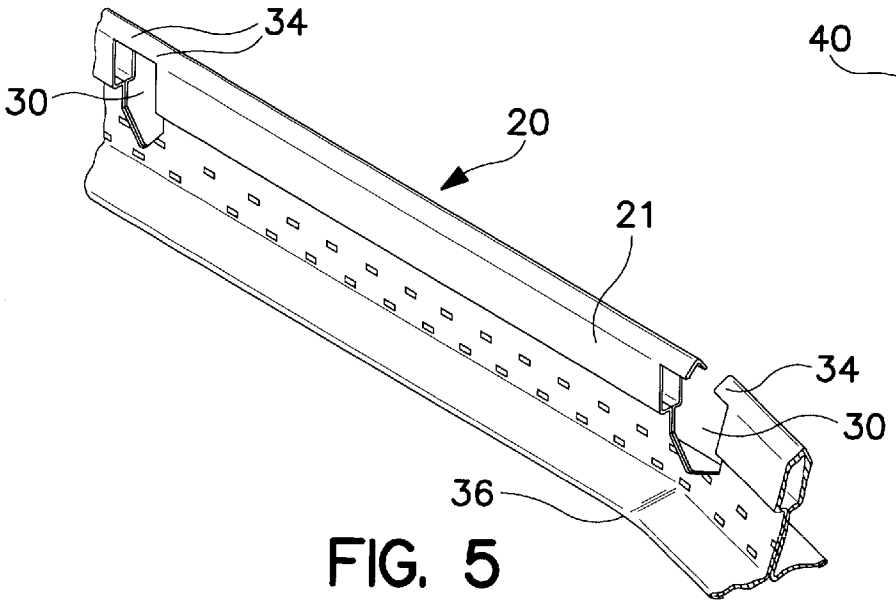
FIG. 5 is a perspective view similar to FIG. 2 showing a bulb segment above a cutout severed and the beam bent to form a concave curve.

The beams 20 of the invention are intended for use in a suspended curved drywall ceiling having concave, or convex, curves as viewed from below.

Where the beams 20 are intended for a concave curve in the ceiling, as viewed from below, selected cutouts 30 along the beam 20, as seen in FIG. 5, are cut at the job site by simply slitting across bulb segment 34, for instance, with shears, as seen in FIG. 5. The beam 20 is then bent at 36, as seen in FIG. 5, to the desired faceted concave curve 37, as seen for instance in FIG. 7. There is little resistance to such bend at 36, and because of the cutout 30 shape, the bend at 36 occurs directly below the apex 38 of the V 33, along a bend line transverse to the beam 20 length.

Figure 6:
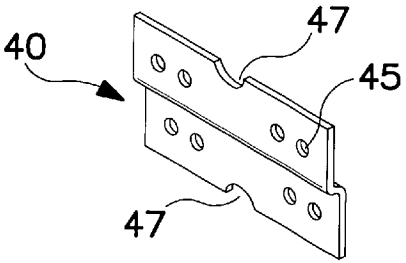
FIG. 6 shows a splice plate used to fix the bend in the beam of FIG. 5.
Figure 7:
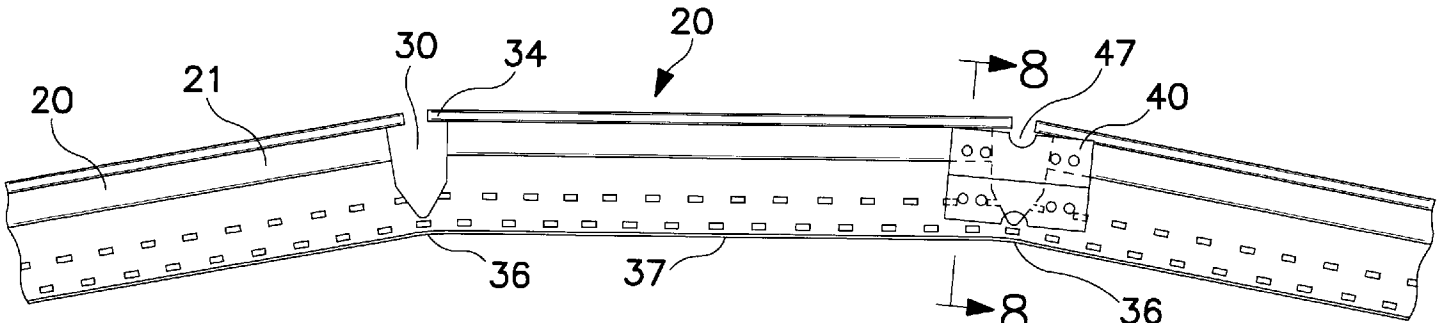
FIG. 7 is a side elevation of a beam of the invention bent in a concave curve, with the splice plate of FIG. 6 a fixed in place at one of the bends.
Figure 8:
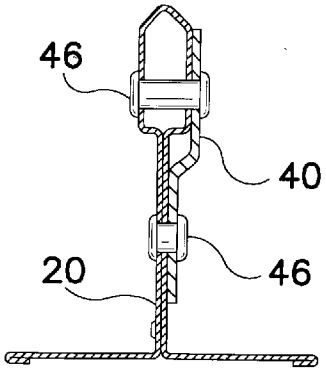
FIG. 8 is a transverse sectional view taken on the line 8—8 in FIG. 7.

A splice plate 40 of the type shown in FIG. 6 is then affixed over the cutout 30 at the bend at 36 to stabilize the faceted concave curve 37. The plate 40 is S shaped in cross section to conform to the contour of the side of the beam 20 when affixed to the beam 20 at the bend at 36, as seen in FIGS. 7 and 8. The plate 40 has holes 45 through which screws or rivets 46 affix the plate 40 to the beam 20. Semi-circular openings 47 at the top and bottom of the plate 40 avoid interference with the bulb 21, when the beam 20 is bent to form a convex curve 50, when viewed from below, as now described.

Figure 9:
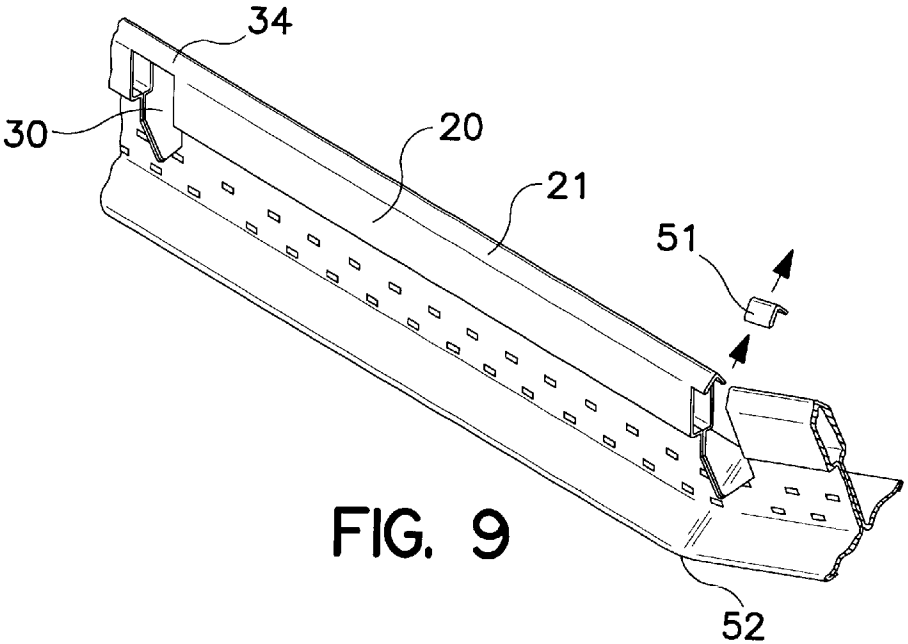
FIG. 9 is a perspective view similar to FIGS. 2 and 5 showing a cutout severed by removing a segment of the bulb in a beam and the beam bent to form a convex curve.

When the beam 20 is used to form a convex curve 50, a short piece 51 of the bulb segment 34, above the cutout 30, as seen in FIG. 9, is snipped away manually at the job site, at the desired cutout 30. The beam 20 is then bent at 52 to the desired convex curve 50 radius, as seen in FIGS. 9 and 10, and a splice plate 40 attached with screws or rivets 46.

Figure 10:
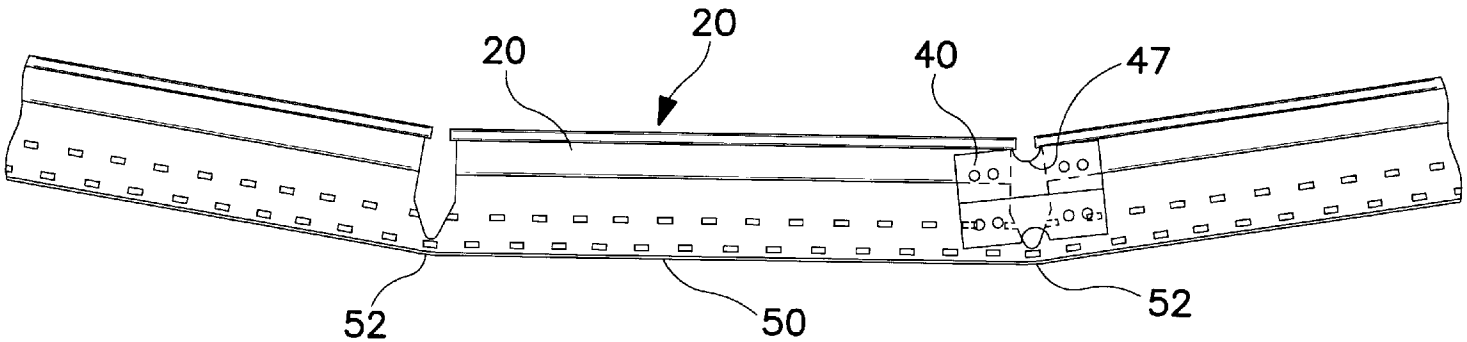
FIG. 10 shows the beam of the invention bent into a convex curve at the cutouts, with the splice plate of FIG. 6 affixed to one of the cutouts.

As seen in FIG. 10, semi-circular openings 47 in the splice plate 40 eliminate any interference, at the top of the plate 40, from the portion of the bulbs 23 that form the apex at the bend at 52. The splice plates 40 are symmetrical vertically and horizontally, so there is always such an opening 47 at the top of the plate 40.

After forming the beam 20 into a faceted concave or convex curve, 37 or 50, as in FIG. 7 or 10, the beam 20 is suspended from a structural ceiling in the usual prior art way, as by hanger wires, and cross beams are inserted in the usual prior art way, to form the curved grid.

Drywall panels are then attached to the beam flanges 23,25 on the underside of the grid, in the usual prior art way, as by self tapping screws. In applying the drywall to the grid, the faces of the drywall panels are wetted, and then are bent to the desired shape to conform to the faceted grid, prior to attachment to the grid.

What is claimed is:

1. In a straight beam (20) having an inverted T cross section, with a bulb (21) at the top, a vertical web (22), and horizontal flanges (23,25) extending from the bottom of the web (22), capable of being formed in the field into a faceted curved beam (37,50) for use in a curved suspended ceiling, the improvement comprising cutouts (30) spaced along the beam with each of the cutouts (30) extending into the bulb (21) and the web (22) and leaving an intact segment (34) of the bulb (21) above each cutout (30);

wherein the straight beam (20) is capable of being formed in the field into a faceted curved beam (37,50) by cutting the intact segment (34) of the bulb (21) of a cutout (30), bending the beam (20) at the cutout (30), and fixing the bend (36,52) at the cutout (30) by securing a splice plate (40) to the beam (20) at each cutout (30).

2. The beam (20) of claim 1 wherein the beam (20) is capable of being formed into a concave faceted curved beam (37).

3. The beam (20) of claim 1 wherein the beam (20) is capable of being formed into a convex faceted curved beam (50).

4. The beam (20) of claim 1 made by the process of a) passing a strip of metal (11) continuously through a roll forming operation (12) to form the strip (11) into a moving continuous straight beam (20), while b) simultaneously with the roll forming operation (12), punching the cutouts (30) into the moving continuous straight beam (20), c) cutting the moving continuous straight beam (20) into straight lengths, and d) forming the connectors at the end of each length of beam (20).

5. The method of making the beam of claim 1 comprising a) passing a strip of metal (11) continuously through a roll forming operation (12) to form the strip (11) into a moving continuous straight beam (20), while b) simultaneously with the roll forming operation (12), punching the cutouts (30) into the moving continuous straight beam (20), c) cutting the continuous straight beam (20) into straight lengths, and d) forming the connectors at the end of each length of beam (20).

* * * * *